United States Patent [19]

Broms et al.

[11] 3,999,395

[45] Dec. 28, 1976

[54] SUPPORT ARRANGEMENT FOR A CONSTRUCTION

[75] Inventors: Bengt Broms, Vallingby; Åke Lindström, Solna; Ian Larsen, Taby, all of Sweden

[73] Assignee: AB Vattenbyggnadsbyran, Stockholm, Sweden

[22] Filed: Apr. 22, 1974

[21] Appl. No.: 462,783

[30] Foreign Application Priority Data

Apr. 26, 1973 Sweden ..... 7305924

[52] U.S. Cl. ..... 61/99; 61/1 R; 61/35; 61/50

[51] Int. Cl.[2] ..... E02D 17/00; E02D 27/38

[58] Field of Search ..... 61/50, 52, 46.5, 53.5, 61/53, 1, 35

[56] References Cited

UNITED STATES PATENTS

| | | | |
|---|---|---|---|
| 720,997 | 2/1903 | Becker | 61/50 |
| 2,468,265 | 4/1949 | Larquetoux | 61/50 |
| 2,472,869 | 6/1949 | Travers | 61/46 |
| 2,938,353 | 5/1960 | Vorenkamp | 61/46.5 |
| 3,667,178 | 6/1972 | Algers | 61/50 X |
| 3,677,018 | 7/1972 | Van Weele | 61/53.5 |
| 3,683,633 | 8/1972 | Van Weele | 61/53 |
| 3,717,001 | 2/1973 | Tam | 61/46.5 |
| 3,738,113 | 6/1973 | Madary et al. | 61/46.5 |
| 3,824,795 | 7/1974 | Mo | 61/46.5 |
| 3,863,457 | 2/1975 | Hafskjold | 61/50 |
| 3,911,687 | 10/1975 | Mo | 61/46.5 |

FOREIGN PATENTS OR APPLICATIONS

| | | | |
|---|---|---|---|
| 1,088,804 | 10/1967 | United Kingdom | 61/46.5 |

*Primary Examiner*—Jacob Shapiro
*Attorney, Agent, or Firm*—Robert C. Baker

[57] ABSTRACT

The invention refers to a foundation or support arrangement to be secured to the lowermost surface of a construction or to one of the lowermost surfaces of a number of legs for supporting a construction intended for marine or submarine installation. According to the invention the foundation or support arrangement comprises a plurality of downwardly directed support elements defining one or more cells or spaces therebetween which are open at the bottom. Said support elements are arranged to penetrate into any deposits present on the bottom of a sea or lake when the construction is positioned on the bottom, said deposits being received in the cells or spaces to a degree dependent on the contour of the bottom.

12 Claims, 13 Drawing Figures

SUPPORT ARRANGEMENT FOR A CONSTRUCTION

Figure 1:
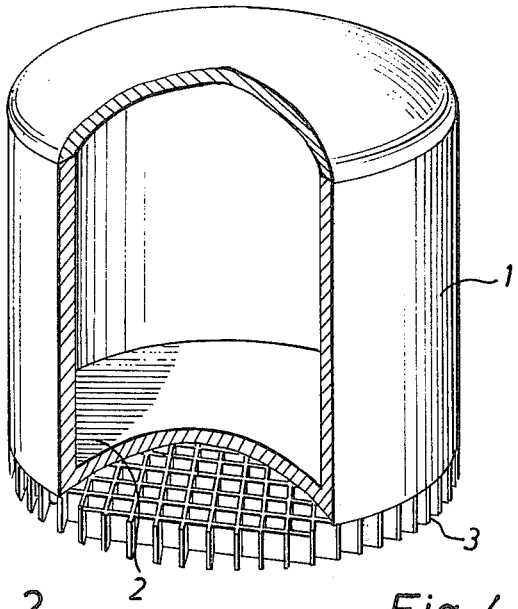

The present invention relates to a foundation or support arrangement for a construction intended for marine or submarine installation in a lake or sea. Examples of constructions in accordance with the invention may be oil storage tanks and production platforms. The term "marine or submarine installation" in this specification means "installation or location above, at or below water level".

Foundation structures and support arrangements for constructions intended for marine or submarine installation have become the object of increased interest in connection with the current exploitation of natural resources existing at or under the sea bed, such as, for example, North Sea oil. The forces exerted on such constructions at or below the surface of the water by waves, together with forces exerted by wind, are of such magnitude that the problems related to the foundation structures or support arrangements are often the most important problems associated with designing a construction intended for marine or submarine installation.

When placing a construction having a flat lower side on the sea bed, it is essential that the bed is extremely level. This requires careful and expensive levelling operations over the area of sea bed concerned. Alternatively a bottom plate of the construction may be reinforced so that it can carry the construction and its contents when resting on the sea bed with only a few points of contact. If the sea bed is levelled the installation becomes expensive and if the bottom plate of the construction is reinforced the cost of the construction itself increases.

Usually when the bottom plate of the construction is reinforced, and where the sea bed so levelled, the dead weight of the construction is made large to provide the necessary friction between the construction and the sea bed with the object of absorbing horizontal forces acting for the construction, and this expedient involves certain expenditure. Where a tall structure is provided it may be necessary to provide expensive piling extending from the reinforced lower region of the structure to the upper regions of the structure to provide adequate support.

Piling would also be required for a construction such as a platform which is designed to be supported by a plurality, e.g. more than three, of support or footings.

The present invention seeks to provide a foundation or structure or foundation or support structures for a construction for marine or submarine installation.

According to the broadest aspect to the invention there is provided a support arrangement suitable for being secured to the lowermost surface of a construction intended for marine or submarine installation or suitable for being secured on the lowermost surfaces of a number of legs for supporting a construction intended for marine or submarine installation, said foundation or support arrangement comprising a plurality of downwardly directed support elements which are arranged to define one or more cells or spaces therebetween, said cells or spaces being open at the bottom, said support elements being arranged to penetrate into the bottom of a sea or lake when the construction is positioned on the bottom of said sea or lake, the said deposits being received in said cells or spaces to a degree dependent on the contour of the sea or lake bottom. Said cells or spaces may be open or closed at the top.

Conveniently the support elements may comprise vertical plates defining cells open at the bottom and having rectangular cross-section. Alternatively the support elements may be hollow pipes or solid pillars.

A construction provided with a foundation or support arrangement in accordance with the invention can be placed on an uneven bed without this first having to be levelled. However, if the sea bed is levelled the bed does not need to be levelled with great precision. It will be understood that the construction will still be resting on a plurality of points via the support arrangement with said support elements penetrating into any original layer or deposit on the bottom, the depth of penetration being dependent on the loads and applied and on the nature of the original layer or deposits. After the cells are thus filled with deposit, or after introducing a material to the cells to act as ballast the construction may be able to absorb considerable forces acting on it without being displaced and/or without ruptures occuring in the foundation. Furthermore, the capacity to absorb horizontal forces is improved although the dead weight of the original construction may be minimal.

When the bottom of a sea or lake comprises rock, or is extremely uneven, a bed of suitable material may be laid thereon, onto which the construction is sunk. The construction may be secured to the bottom of the sea or lake by a pile arrangement.

If necessary the foundation or support arrangement may be provided with water flushing channels at the lower edges of the support elements to facilitate penetration into the bed of a sea or lake.

When said cells or spaces are of sufficient height and are filled with deposit present on the sea bed or other material vertical loads may be absorbed as friction between the contents of the cells and the walls of the cells thus providing a resistance to motion between the cells and the contents of the cells.

It will be understood that a vertical load can be absorbed by the cells and their contents that corresponds to a vertical load that could be absorbed if the cell structure was a solid slab. The load that may be carried corresponds to the bearing capacity of the layers on which the bottom of the cell structure rests.

Resistance to upward vertical movement of the structure is related to the weight of contents of the cells. In other words the cell structure and cell contents behave as a solid structure.

In utilizing a structure in accordance with the invention it may be found that:

1. The load is distributed evenly over the foundation area or between the footings or legs although originally the bed was not completely levelled.

2. Where the upper layers of the sea or lake bed are soft or loose, the empty cell structure cuts through these layers and the construction is supported by lower layers of higher bearing capacity.

3. The contents of the cells act as part of the final structure although not being part of the installed structure.

4. The lateral load absorbing capacity is higher than for a structure resting on a solid slab.

Figure 2:
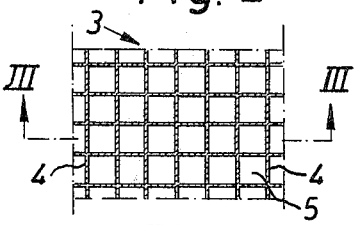
Figure 4:
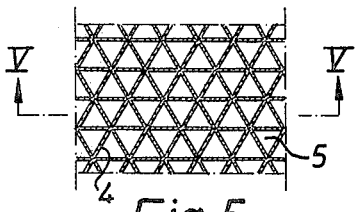
Figure 3:
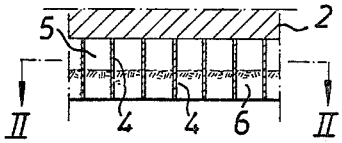
Figure 5:
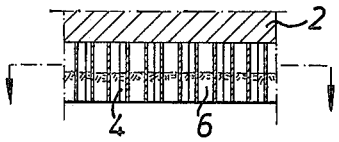
Figure 6:
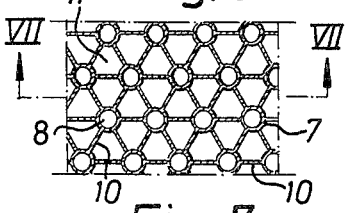
Figure 8:
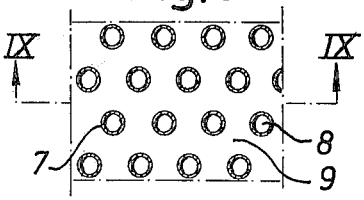
Figure 7:
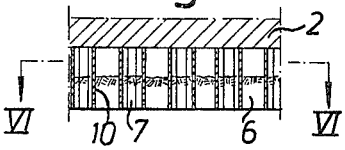
Figure 9:
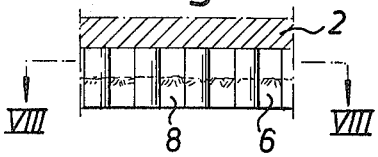
Figure 10:
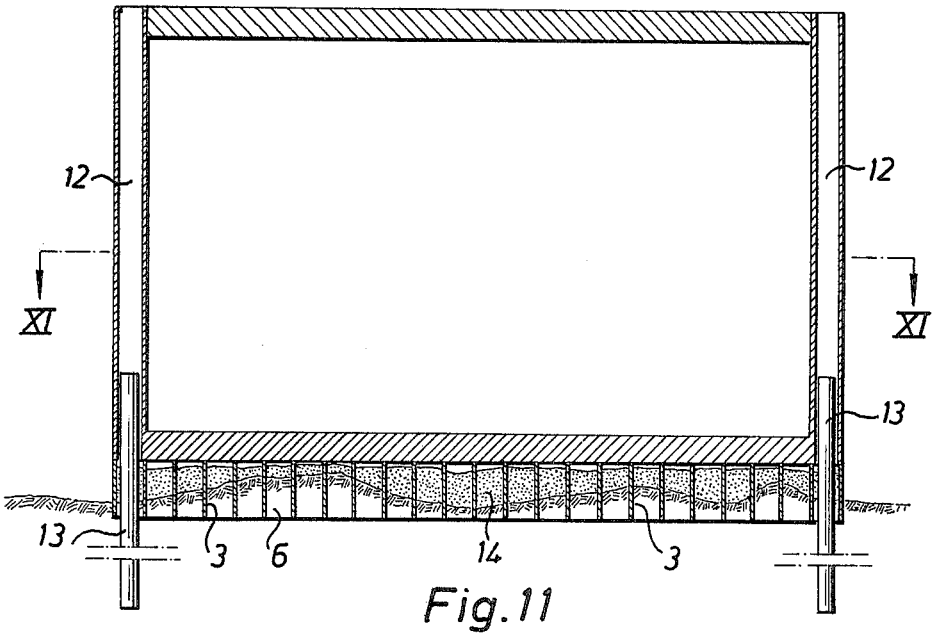
Figure 11:
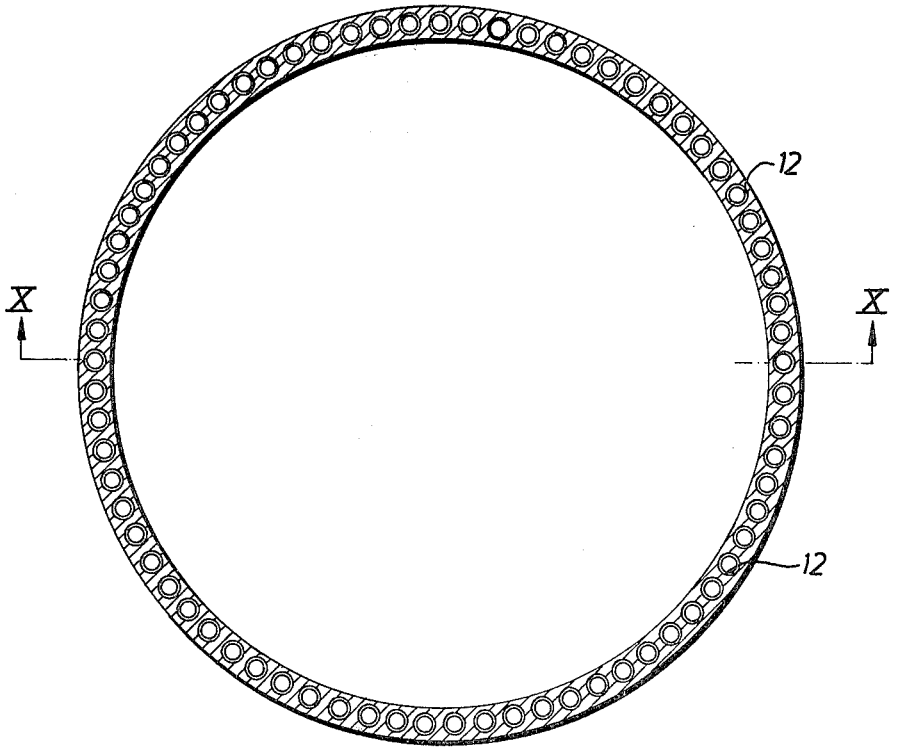
Figure 12:
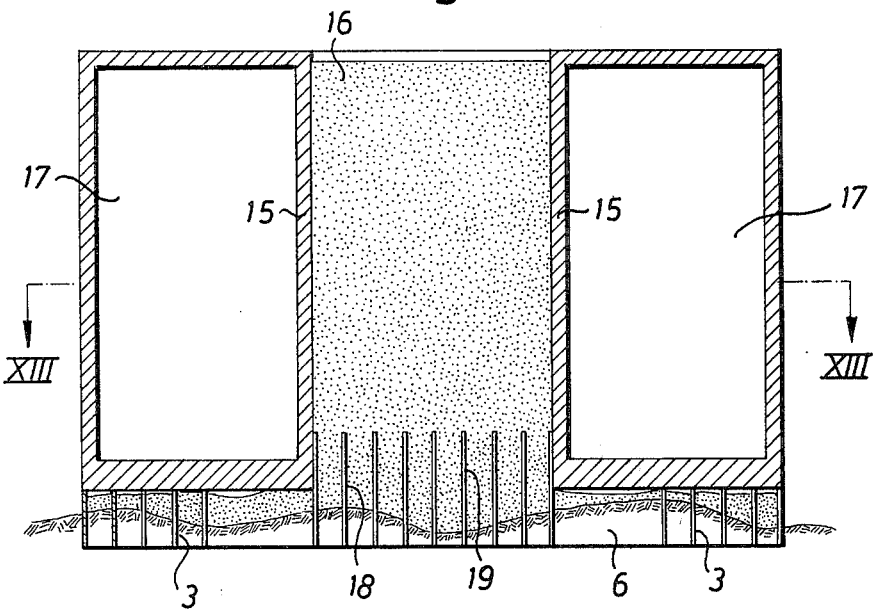
Figure 13:
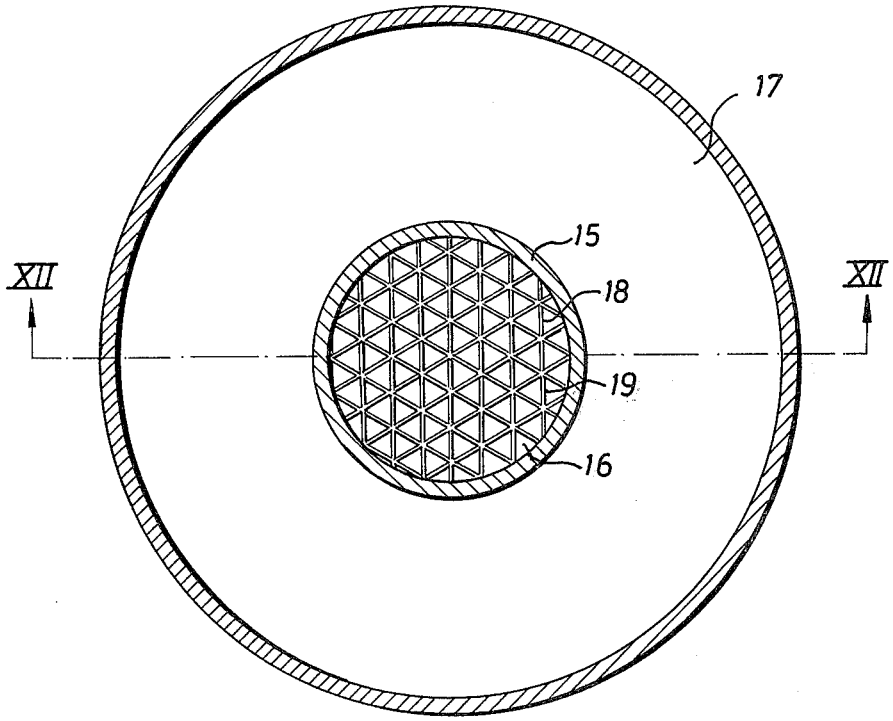

In order that the invention may be more readily understood, and so that further features thereof may be more readily appreciated, the invention will now be described, by way of example, with reference to the accompanying drawings in which:

FIG. 1 is a schematic perspective view of an oil tank in accordance with the invention, with parts thereof cut away, FIG. 2 is a plan view of one form of support arrangement for use in embodiments of the invention, FIG. 3 is a diagrammatic sectional view along the line III — III of FIG. 2, FIG. 4 is a plan view of another form of support arrangement for use in embodiments of the invention, FIG. 5 is a diagrammatic sectional view along the line V — V of FIG. 4, FIG. 6 is a plan view of yet another form of support arrangement for use in embodiments of the invention, FIG. 7 is a diagrammatic sectional view along line VII — VII of FIG. 6, FIG. 8 is a plan view of yet a further form of support arrangement for use in embodiments of the invention, FIG. 9 is a diagrammatic sectional view along the line IX — IX of FIG. 8, FIG. 10 is a vertical sectional view of a tank in accordance with the invention and provided with piles, FIG. 11 is a sectional view along the line XI — XI of FIG. 10, FIG. 12 is a vertical sectional view of a tank having a central space for ballast and provided with peripheral and central support arrangements in accordance with the invention, and, FIG. 13 is a sectional view along the line XIII — XIII of FIG. 12.

FIG. 1 illustrates a tank 1 having a bottom plate 2 with a gridlike support arrangement 3 mounted below the bottom plate 2.

The support arrangement, which is firmly secured to the tank, may be constructed in many different ways, and various forms of support arrangement as illustrated in FIGS. 2 to 9. It is to be understood that the support arrangement may extend under the entire lower surface of the tank or only under selected parts of the lower surface of the tank.

The support arrangement shown in FIGS. 2 and 3 consists of vertical, flat, slab-shaped support elements 4 forming cells 5 which are open at the bottom, each cell having a square cross-section, into which any sedimentary deposit 6 or the bottom of the lake or sea in which the tank is located may penetrate.

In FIGS. 4 and 5 a support structure is shown comprising vertical, flat support elements 4 which form cells which are open at the bottom and which are of triangular cross-section. Some of the support elements 4 in the support arrangements illustrated in FIGS. 2 to 5 may be replaced by connecting elements which join together neighbouring support elements or groups of support elements, the connecting elements only protruding from the base 2 of the tank by a small distance.

FIGS. 6 to 9 illustrate two support arrangements which are formed by vertical, tubular support elements 7 defining cells 8, open at the bottom, there being spaces 9 between the support elements 7. The support elements 7 may be joined together by vertical, flat support elements 10 as shown in FIG. 6 said spaces 9 thus being divided into cells 11 which are open at the bottom. These support elements 10 can be entirely or partially replaced by connecting elements only protruding a small distance from the base 2 of the tank. The support elements 7 in the support arrangements illustrated in FIGS. 6 to 9 be in the form of solid pillars.

The support arrangement may be directly secured to the bottom plate of the tank or it may be arranged to be secured to the tank by means of an intermediate plate. Of course the support elements may be shaped differently and arranged in other ways than those particularly described above. The support elements, which preferably have a substantially uniform height, may be distributed all over the lower side of the tank or only over selected parts of the bottom of the tank and may be confined to a peripheral region or to several concentric or radial groups or rows. There may also be openings in the upper parts of at least some of the support elements forming the support arrangement, through which sand or some other suitable material can be pumped to fill up the spaces in the cells not filled by any deposit present on the bottom of the sea or lake in which the tank is to be used. These openings in the support arrangement may also be entirely or partially formed in connecting elements extending between the support elements. The sand or other material pumped into the spaces in the cells can be removed by suction, for example, if the tank is to be moved to another location. When a support arrangement as herein described is used, no extensive levelling of the sea bed is required and the support arrangement may be capable of supporting a large load. Due to the engagement of the elements of the support arrangement and any deposits on the bottom of the sea the tank may be able to withstand horizontal forces caused, for example, by wind and the waves, which may otherwise tend to move the tank sideways. The sand pumped into the cells formed by the support elements may be considered to act as ballast.

FIGS. 10 and 11 illustrates a tank in which the walls have been provided with vertical, cylindrical bores 12 therethrough. These bores may be utilized as guides for a suitable number of piles 13 in cases where it is considered necessary to anchor the tank to the sea or lake bed, particularly if layers of sediment at the bottom of the sea or lake are not capable of supporting a large weight. The piles may be joined to the support elements of the arrangement by injection or casting. For example, grouting or concrete or some other settable material may be introduced into the bores to secure the support elements with reference to the piles, or alternatively a mechanical locking device adapted to lock the piles against movement relative to the bores may be provided. The use of cylindrical bores or bores with some other suitable cross-section in the walls of the tank reduces the dead weight of the tank and thus also reduces the depth to which the tank sinks when being towed out to the installation site. The vertical bores are preferably entirely filled with sand or some other suitable material after the tank has been located on the lake or sea bed and any piling and joining the piles to the support elements has been performed. The sand or other material may later be removed from the bores if the tank is to be moved to another site. As can be seen from FIG. 10, the tank is supported by a support arrangement joined thereto, in the form of vertical support elements 4 which may be flat or curved, so that deposits 6 on the sea or lake bottom penetrate up between the support elements to a varying degree depending on the bottom contour. Sand or some other suitable material 14 is pumped into the spaces above the deposits 6, this being done, for example, from the sides of the tank through openings in the support elements or via special supply pipes fitted to the lower side of the tank for this purpose.

FIGS. 12 and 13 show a tank provided with a cylindrical inner wall 15 surrounding a central space 16. With such an inner wall the construction of the roof and bottom of the tank is simpler and less expensive than the construction of the roof and bottom of the tank illustrated in FIGS. 10 and 11. The central space 16 is preferably not used for storing the product which is intended to be stored in the annular inner region 17 of the tank. The central space 16 may be open at both ends as shown in FIG. 12 and may with advantage be filled with sand or some other suitable granular material such as, for example, ore concentrates, to act as ballast when the tank has been located on the sea or lake bed. The inner wall 15 therefore needs no reinforcement and may be made of thin sheet metal, for example, since the said granular material tends to give the inner wall sufficient rigidity and support. A support arrangement in the form of a grid 18 may be arranged at the bottom of the central space 16, this grid being firmly secured to the tank and arranged to extend up through the central space and down to approximately the level of a support arrangement located below the storage space of the tank. The central grid 18 shown here consists of vertical, flat elements 19 forming cells having triangular cross-section. However, the vertical elements may of course be arranged in some other way in a grid, for example as in the support arrangements described with reference to FIGS. 2 and 3. The support arrangement used in the tank illustrated in FIG. 12 is arranged peripherally under the tank but if desired it may be extended towards the central grid and may be combined with this central grid. The central grid, which also acts as support arrangement if it is joined to the tank, ensures that the granular material ballast does not run our of the central space if, due to the forces exerted thereon, the tank should be deformed or lifted. Cooperation between the ballast and the deposits forming the original bed of the sea or lake ensure with water flushing channels to assist the elements in penetrating a layer of deposit on the bed.

It is also to be understood that whilst all the specifically described embodiments of the invention have comprised tanks for storing a fluid such as oil the invention may also be applied to other constructions intended for marine or submarine installation, such as drilling platforms.

One such drilling platform may be combined with a storage tank having a foundation structure in accordance with the present invention, or the platform may be supported by separate legs, each said leg, having a foundation structure in accordance with the present invention. The said legs may or may not be connected to each other.

What we claim is:

1. A marine construction highly resistant to displacement by horizontal marine forces, said construction comprising a marine structure and a submarine foundation arrangement fixed on the lowermost surface of said marine structure over substantially all portions of said lowermost surface, said foundation arrangement comprising a plurality of downwardly directed support elements consisting essentially of vertical flat plate-like walls, said walls being interconnected in a gridlike network to form a multiplicity of discrete cells or spaces, each said cell or space being adjacent to others thereof and separated therefrom by a common said vertical flat plate-like wall, each said cell or space substantially exclusively having angular corners of no more than 90° in horizontal cross-section, substantially all of said cells or spaces being open at the bottom, said foundation arrangement being further characterized by the fact that at least some of said plate-like walls extend outwardly from peripheral cell structures of said foundation arrangement, said support elements of said foundation arrangement being penetrated into any deposits present on the bottom of a sea or lake with said foundation arrangement positioned in substantially level condition at the bottom of said sea or lake, the said deposits being received in different of said cells or spaces to a degree dependent on the contour of the sea or lake bottom, whereby said penetrated deposits and said plate-like downwardly directed support elements effectively function in combination as a solid motion-resistant and erosion-resistant foundation for said marine structure.

2. A construction according to claim 1 wherein said cells or spaces are substantially exclusively triangular in cross-section.

3. A construction according to claim 1 wherein the elements forming the arrangement are of concrete or steel.

4. A construction according to claim 1 wherein the cells or spaces are open at the top.

5. A construction according to claim 1 wherein the cells or spaces are closed at the top.

6. A construction according to claim 1, wherein said marine structure comprises an oil drilling platform.

7. A construction according to claim 1, wherein said marine structure has vertical walls provided with vertical bores which serve as guide means for a number of piles driven through the construction into the bed of the sea or lake.

8. A construction according to claim 7, wherein said piles are joined to elements forming said foundation arrangement.

9. A construction according to claim 1 wherein said marine structure is in the form of a tank.

10. A construction according to claim 1 wherein water flushing channels are provided on the lower surfaces of said support elements.

11. A marine construction highly resistant to displacement by horizontal marine forces, said construction comprising a marine structure in the form of a tank annular in plan, said annular tank marine structure having a central inner wall surrounding a central space, and a submarine foundation arrangement fixed on the lowermost surface of said marine structure over substantially all portions of said lowermost surface as well as extending across said central space, said foundation arrangement comprising a plurality of downwardly directed support elements consisting essentially of vertical flat plate-like walls, said walls being interconnected in a gridlike network to form a multiplicity of discrete cells or spaces, each said cell or space being adjacent to others thereof and separated therefrom by a common said vertical flat plate-like wall, each said cell or space having angular corners in cross-section, substantially all of said cells or spaces being open at the bottom, said support elements being penetrated into any deposits present on the bottom of a sea or lake with said foundation arrangement positioned in substantially level condition at the bottom of said sea or lake, the said deposits being received in different of said cells or spaces to a degree dependent on the contour of the sea or lake bottom, whereby said penetrated deposits and said plate-like downwardly directed support elements effectively function in combination as a solid motion-resistant and erosion-resistant foundation for said marine structure.

12. A construction according to claim 11 wherein said central space is filled with a granular material.

* * * * *